US007819287B2

(12) United States Patent
Suzuki

(10) Patent No.: US 7,819,287 B2
(45) Date of Patent: Oct. 26, 2010

(54) CONTAINER WITH SEALING CAP

(75) Inventor: Koji Suzuki, Yokohama (JP)

(73) Assignee: Fancl Corporation, Kanagawa (JP)

( * ) Notice: Subject to any disclaimer, the term of this patent is extended or adjusted under 35 U.S.C. 154(b) by 594 days.

(21) Appl. No.: 11/573,442

(22) PCT Filed: Aug. 5, 2005

(86) PCT No.: PCT/JP2005/014404

§ 371 (c)(1),
(2), (4) Date: Mar. 8, 2007

(87) PCT Pub. No.: WO2006/016531

PCT Pub. Date: Feb. 16, 2006

(65) Prior Publication Data

US 2009/0224001 A1 Sep. 10, 2009

(30) Foreign Application Priority Data

Aug. 9, 2004 (JP) ..... 2004-232180

(51) Int. Cl.
*B67B 1/00* (2006.01)

(52) U.S. Cl. ..... 222/153.06; 215/250; 220/258.3

(58) Field of Classification Search ..... 222/153.1, 222/153.05, 153.06, 153.13, 182, 256, 260, 222/321.9, 541.1, 541.6; 220/258.1, 258.3; 215/258, 250, 252

See application file for complete search history.

(56) References Cited

U.S. PATENT DOCUMENTS

| | | | | | |
|---|---|---|---|---|---|
| 3,038,633 | A | * | 6/1962 | Foster | 220/324 |
| 3,162,329 | A | * | 12/1964 | Gregory | 222/182 |
| 3,198,400 | A | * | 8/1965 | Roehrich | 222/182 |
| 4,353,483 | A | * | 10/1982 | Pehr | 222/153.02 |
| 4,685,594 | A | | 8/1987 | Czech | |
| 5,092,493 | A | * | 3/1992 | Pehr | 222/153.02 |
| 5,350,116 | A | * | 9/1994 | Cater | 239/333 |
| 5,931,351 | A | | 8/1999 | Renualt et al. | |

FOREIGN PATENT DOCUMENTS

| | | | |
|---|---|---|---|
| AT | 52986 | | 6/1990 |
| EP | 0 250 922 | A2 | 1/1988 |
| EP | 0 829 430 | A1 | 3/1998 |
| EP | 1 002 737 | A1 | 5/2000 |
| EP | 1002737 | A1 * | 5/2000 |
| FR | 2 753 179 | | 7/1997 |
| JP | 08-011912 | | 1/1996 |
| JP | 10-053261 | | 2/1998 |
| JP | 10-337509 | | 12/1998 |
| JP | 2000-226047 | | 8/2000 |
| JP | 2002-225894 | | 8/2002 |
| JP | 2003-040297 | | 2/2003 |

* cited by examiner

*Primary Examiner*—Kevin P Shaver
*Assistant Examiner*—Daniel R Shearer
(74) *Attorney, Agent, or Firm*—Knobbe Martens Olson & Bear LLP

(57) ABSTRACT

An object of the invention is to provide a container which does not show a sealing body on the external surface. The invention is a container having a container body with a dispensing device and a lid body, in which a sealing cap is provided between the lid body and the dispensing device.

13 Claims, 11 Drawing Sheets

CONTAINER WITH SEALING CAP

This application is the U.S. National Phase under 35 U.S.C. §371 of International Application PCT/JP2005/014404, filed Aug. 5, 2005, which claims priority to Japanese Patent Application No. 2004-232180, filed on Aug. 9, 2004. The International Application was published under PCT Article 21 (2) in a language other than English.

FIELD OF THE INVENTION

The present invention relates to a container.

BACKGROUND TECHNOLOGY

As a container for cosmetics and the like, a pumping container with a lid body has conventionally been known as described in Patent Reference No. 1 (Japanese Patent No. 3278023). The pumping container has been designed elaborately to meet customers' taste.

Further, various products have been sealed so as not to be freely opened by customers while on display or to be purchased by customers with confidence that they have not been opened.

Sealing is done with containers containing various products such as wine, seasonings, cosmetics, and the like. For example, a cap sealing system has been described in Patent Reference No. 2 (Japanese Patent Laid-open 1998-53261), in which the mouth of a container is overlaid and sealed with a shrinkable resin film. In this example, an unused state can be confirmed by the presence of an unbroken sealing since it is necessary to break the sealing to take out the content.

Further, a means for sealing PET bottles containing soft drinks adapts a structure in which a thin brittle bridge is provided on a lid body as described in Patent Reference No. 3 (Japanese Patent Laid-open No. 2003-40297). An unopened state is confirmed by the presence of an unbroken thin brittle bridge.

Further, a means for sealing a tube container in which a sealing member provided on an opening part is broken upon use is generally known (for example, Patent Reference No. 4).

Furthermore, conventionally, a sealing means in which a whole container is placed into a packaging bag has been widely known.

Patent Reference No. 1: Japanese Patent No. 3278023

Patent Reference No. 2: Japanese Patent Laid-open No. 1998-53261

Patent Reference No. 3: Japanese Patent Laid-open No. 2003-40297

Patent Reference No. 4: Japanese Patent Laid-open No. 2002-225894

Problems that the Invention Attempts to Solve

A container with a pump is designed to provide beauty since it often contains a cosmetic fluid and the like on sale. The diameter of a lid body is designed to be the same as that of a container body for good appearance and a narrow space formed between the lid body and the container body is elaborately utilized as a significant line in its design. Therefore, the space formed between the container body and the lid body preferably has a structure that can freely express a designated line. On the other hand, sealing of the product is necessary as described above.

Incidentally, if sealing a designed container with a pump is done by placing the container in a packaging bag or by overlaying the top of the container with a film which can be easily broken, the aesthetic design achieved with considerable effort is marred, which is unfavorable and likely to give customers a disincentive to buy.

Further, if sealing in which a thin brittle bridge is used in a lid body is adopted, the space between the lid body and the container body cannot be arbitrarily chosen so that a design using the space as a line is obstructed. Further, the thin brittle bridge is visible through a gap between the container body and the lid body, which spoils apparent beauty.

Further, a broken piece of the bridge remains on the visible surface of the container as a scar, which looks unattractive.

An objective of the present invention is to provide a container in which a sealing member does not show on the exterior surface in an unused state and a design of the container shows a state of use. In particular, an objective is its application to a container equipped with a dispensing device such as a pump.

Means to Solve the Problems

The major constituents of the present invention are as follows:

(1) A container having a container body equipped with a dispensing device and a lid body, characterized in that a sealing cap is provided between the lid body and the dispensing device.

(2) The container described in (1), characterized in that the dispensing device is a pumping device.

(3) The container described in (1) or (2), characterized in that the container is a container for cosmetics.

(4) The container described in (1), (2), or (3), characterized in that the sealing cap comprises a lower half portion which is fixed onto the container body, an upper half portion which covers a head part of the dispensing device, and a brittle part which connects said lower half and upper half portions.

(5) The container described in (4), characterized in that the brittle part is a thin part or a bridge.

(6) The container described in anyone of (1) to (5), characterized in that the lower half portion of the sealing cap is fixed on an outer periphery of a rising wall provided in a mouth-neck portion of the container body and the brittle part of the sealing cap is furnished to be placed downward from the same height as that of the upper end of said rising wall.

(7) The container described in (6), characterized in that a holding part of the lid body is formed on the outer periphery of the lower half portion of the sealing cap.

Effectiveness of the Invention

The appearance of the container of the present invention can be the same in a state of unuse and in a state of use. Major effects are as follows:

1. A sealing member is prevented from being exposed to exterior in a state of unuse by furnishing the sealing cap inside the lid body so that the container in a state of use can exhibited.

2. A notch is formed on the thin brittle bridge so that a breaking operation can be easily carried out and at the same time the thin brittle bridge can be cut at a specific position. Further, a broken piece can be placed at a hardly visible position.

3. An integrated design of the container body with the lid body is possible without taking a sealing member into consideration.

4. It is effective as a sealing member equipped with a dispensing device such as a pump.

5. The sealing cap of the container with a pump of the present invention does not restrict the degree of the freedom in terms of designing of the lid body since the sealing cap is integrally formed by connecting the upper half portion and the lower half portion via the thin brittle bridge, located inside the lid body and mounted onto the rising wall provided at the mouth-neck portion of the pump body. Further, the thin brittle bridge is not visible through the gap formed between the container body and the lid body so that the apparent beauty is not spoiled. The position of the thin brittle bridge is not on the surface of the container body, which is readily visible to users, so that the broken piece of the thin brittle bridge is not obstructive in use.

6. It reinforces the rising wall and functions as a lid stopper.

EXPLANATION OF THE SYMBOLS

Figure 1:
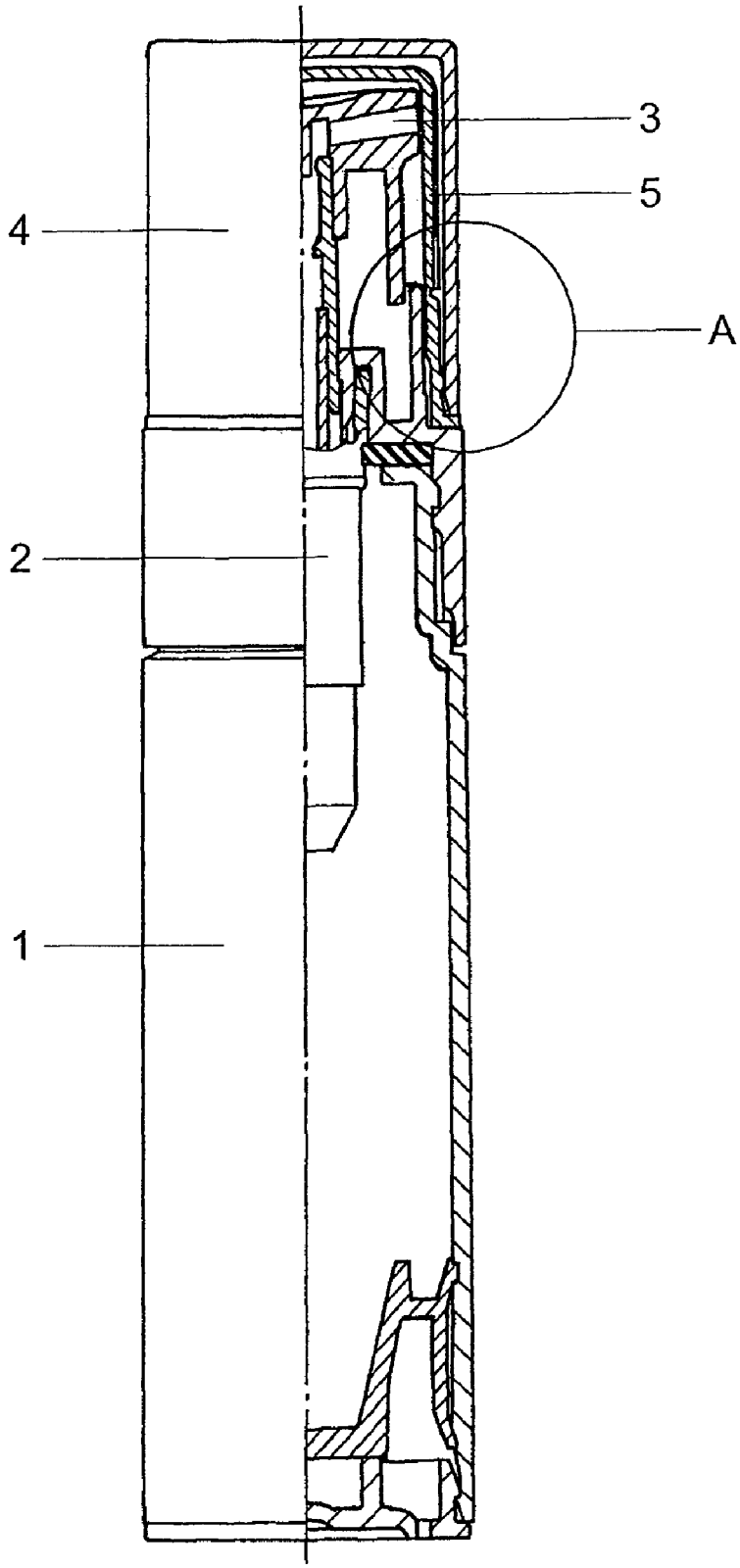
FIG. 1 is a partially sectioned side view of the container with a pump in Example 1.

1. Container body
11. Mouth-neck portion
12. Rising wall
13. Elevated part
2. Pump
3. Nozzle part
4. Lid body
5. Sealing cap
5*a*. Upper half portion
5*b*. Lower half portion
5*c*. Top plate
51. Engaging concave part
52. Protruding part
53. Brim part
54. Elevated protrusion
6. Thin brittle bridge
6*a*. Notch

BEST MODE FOR CARRYING OUT THE INVENTION

The present invention is a container provided with a sealing cap which makes a sealing body inside a lid that is a primary cap.

The sealing cap is not exposed when the lid is on and the position of the lid does not change after removing the sealing cap, which maintains the external appearance of the container the same as in an unused state.

The shape of the container is not restricted and can be cylindrical, oval or the like. The material for the container can be plastic, glass, metal, or the like.

The lid covers the head part of a dispensing device and fits in the mouth-neck portion of the container to be easily put on and taken off. The material for the lid can be plastic, glass, or metal.

The sealing cap is provided between the lid and the dispensing device and covers the head part of the dispensing device, its base end part is fixed onto the mouth-neck portion of the container, and a brittle part is furnished in the intermediate part so that the upper part can be removed in use. Since the brittle part of this sealing cap is broken to release the sealing, plastic or metal is desirable as a material.

The brittle part is furnished so that the upper half portion can be removed by breaking the brittle part, for example, by means of rotating the upper half portion. Its structure can be any shape or configuration which is easily broken, for example, with a grooved thin part, multiple narrow bridge-like structure, or dotting.

The brittle part is preferably positioned at the same height as the rising wall taking reinforcement of the mouth-neck portion into consideration. Further, when it is positioned at a height the same as or slightly lower than the rising wall, the broken scar safely cannot be felt and is unnoticeable.

The dispensing device for dispensing the content of the container is appropriately a pump-type device, a spray-type device, or the like. The device can be with a simple opening; however, in this case, a means such as placing a seal in the opening has to be contrived.

The content is not particularly limited; however, a fluid substance such as a cosmetic liquid is appropriate for a pump-type dispensing device.

The invention is applicable to a container for cosmetics, a container for shampoo, and the like.

The following effectiveness can further be obtained by providing the sealing cap.

In a pump-type dispensing device, the contents can be discharged from a nozzle by up and down folding sliding movement of the nozzle. To prevent foreign substances from being pulled in, a lower sliding part is made in intimate contact. In many cases, by furnishing a rising wall on the mouth-neck portion of the container body, the sliding parts are made intimately contacted. The strength of this rising wall can be improved by overlapping the rising wall with the lower part of the sealing cap. Further, when the lid body is detachably fitted in the mouth-neck portion of the container body, this lower-half portion can be used; since it is reinforced together with the rising wall, strength can be obtained even when providing threads or a protruding part.

Further, fine work can be easily done since the sealing cap is a small member and can be formed using a plastic material which is softer than a material for the container body or the pumping device.

Regarding a manufacturing process, a container body is filled with a content, a dispensing device such as a pumping device is equipped, a sealing cap is fixed and furnished, and a lid is mounted. Softness of the sealing cap is convenient for handling.

Further, the sealing cap can be colored or designed for diversification of products. The top of the sealing cap can be formed unevenly for easy removal.

As mentioned above, strength and safety can be characteristically attained by making the size of the lower half portion, namely the position of the brittle part, to be approximately the same as the rising wall.

EXAMPLE 1

An example of a container with a pump is shown as follows.

Figure 2A:
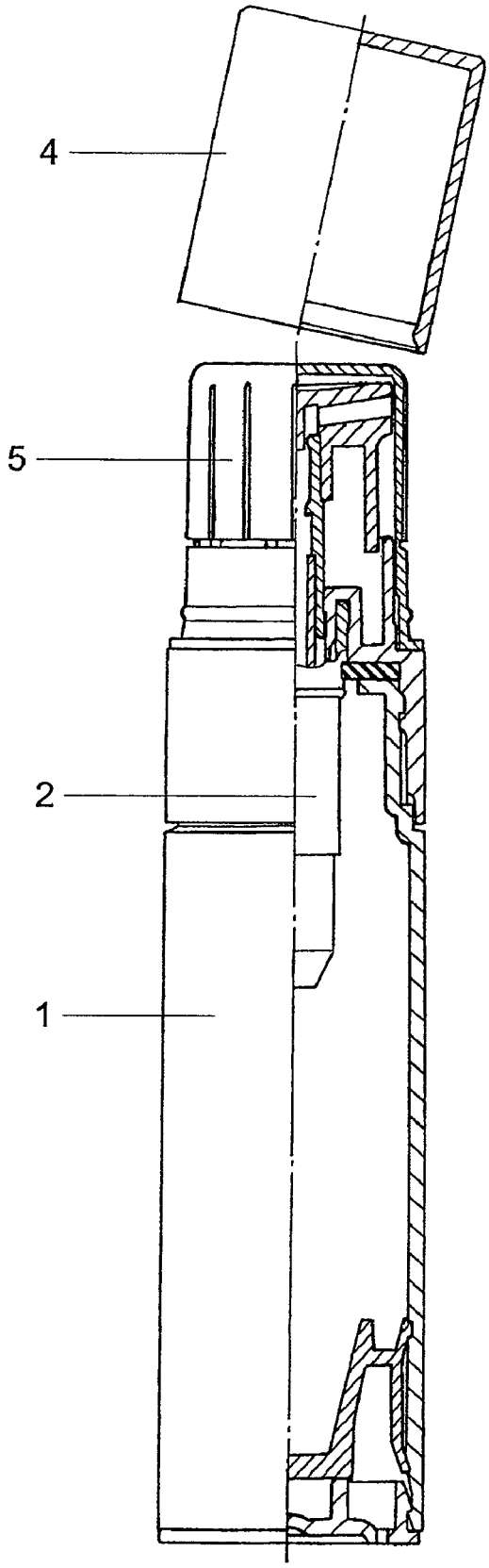
FIG. 2*a* is a side view showing the state in which the lid body of the container with a pump in Example 1 is detached.
Figure 2B:
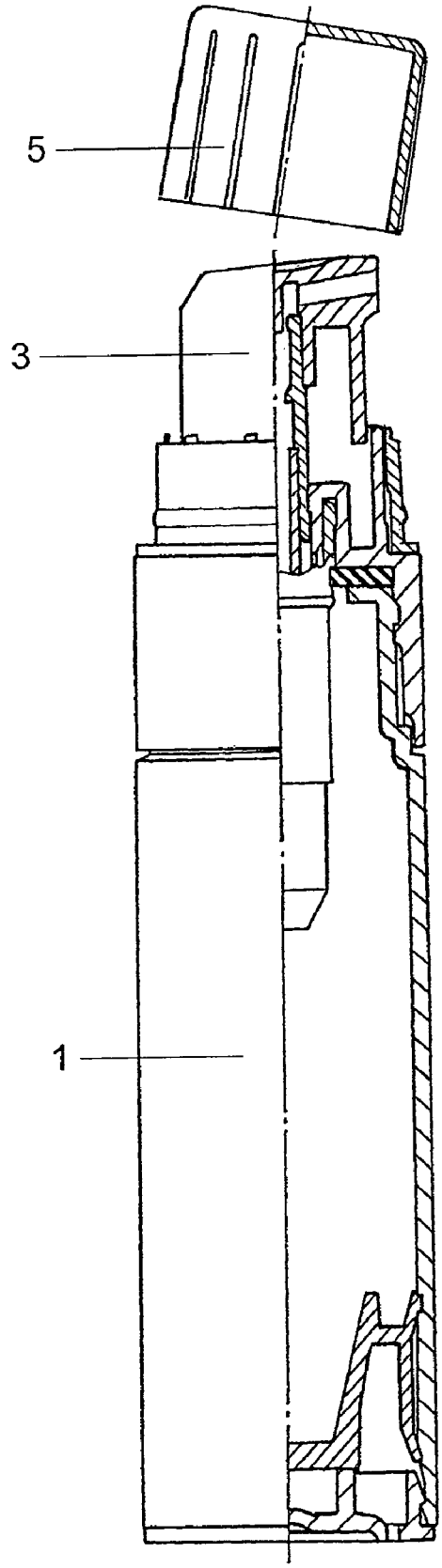
FIG. 2*b* is a side view showing the state in which the upper half portion of the sealing cap of the container with a pump of the present invention in Example 1 is detached.
Figure 2C:
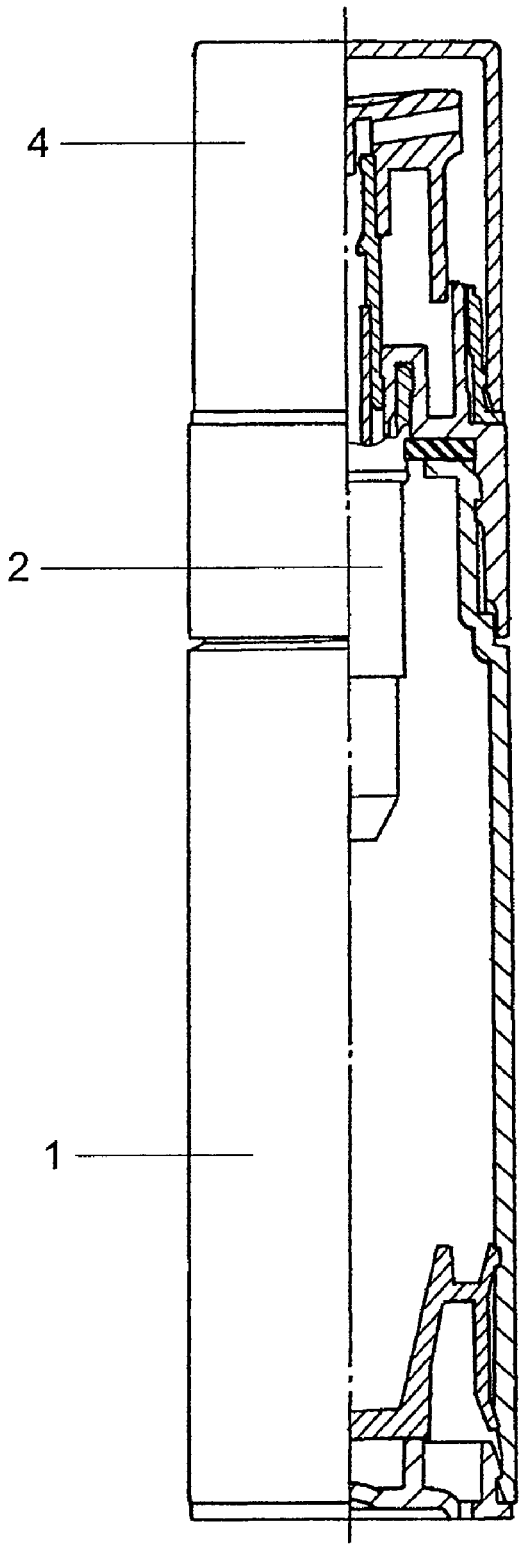
FIG. 2*c* shows the state in which the lid body is mounted after the sealing cap of the container with a pump in Example 1 is removed.
Figure 3:
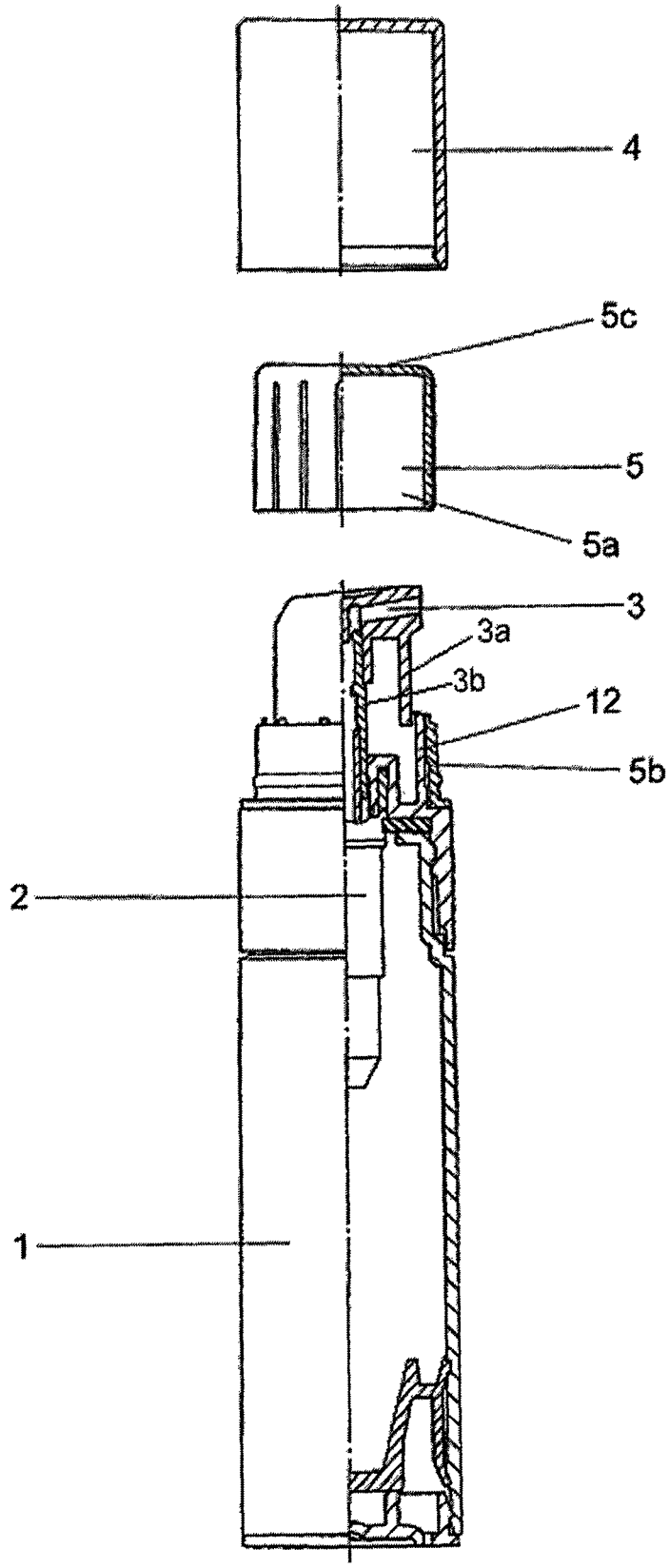
FIG. 3 is a disassembled view of the lid body and the sealing cap of the container with a pump in Example 1.
Figure 4:
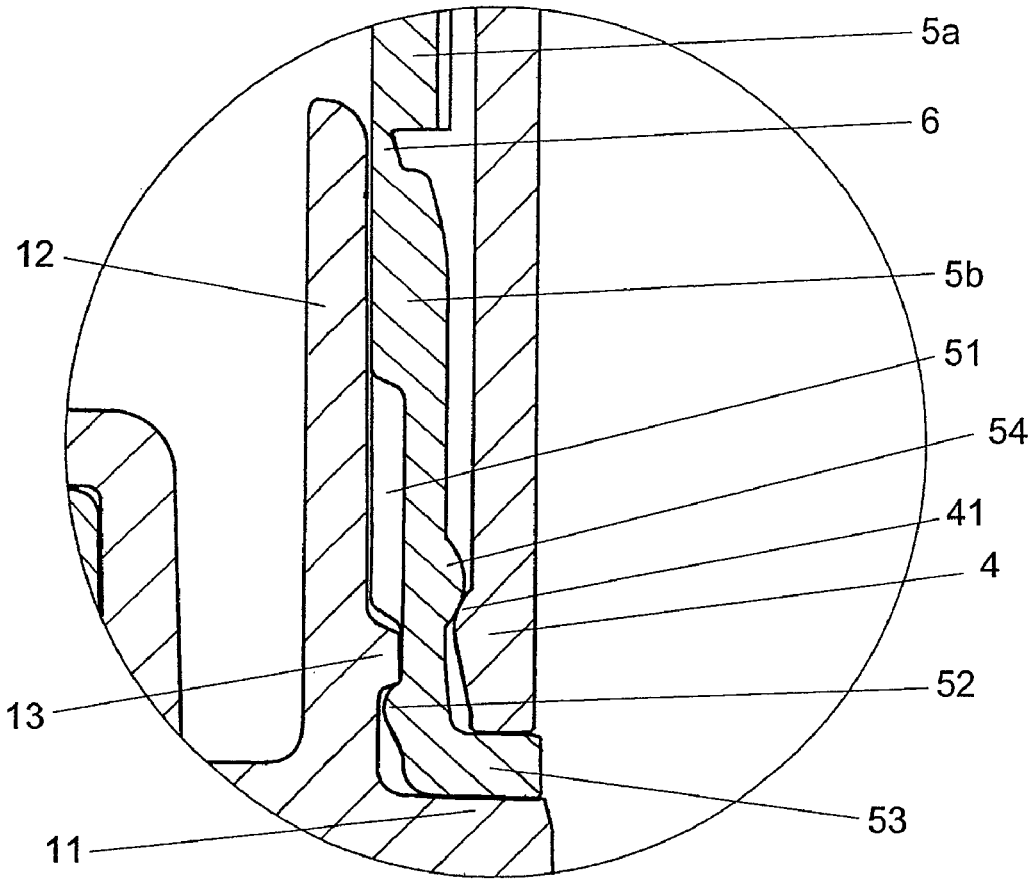
FIG. 4 is a detailed view within the area shown by circle A in FIG. 1.
Figure 5:
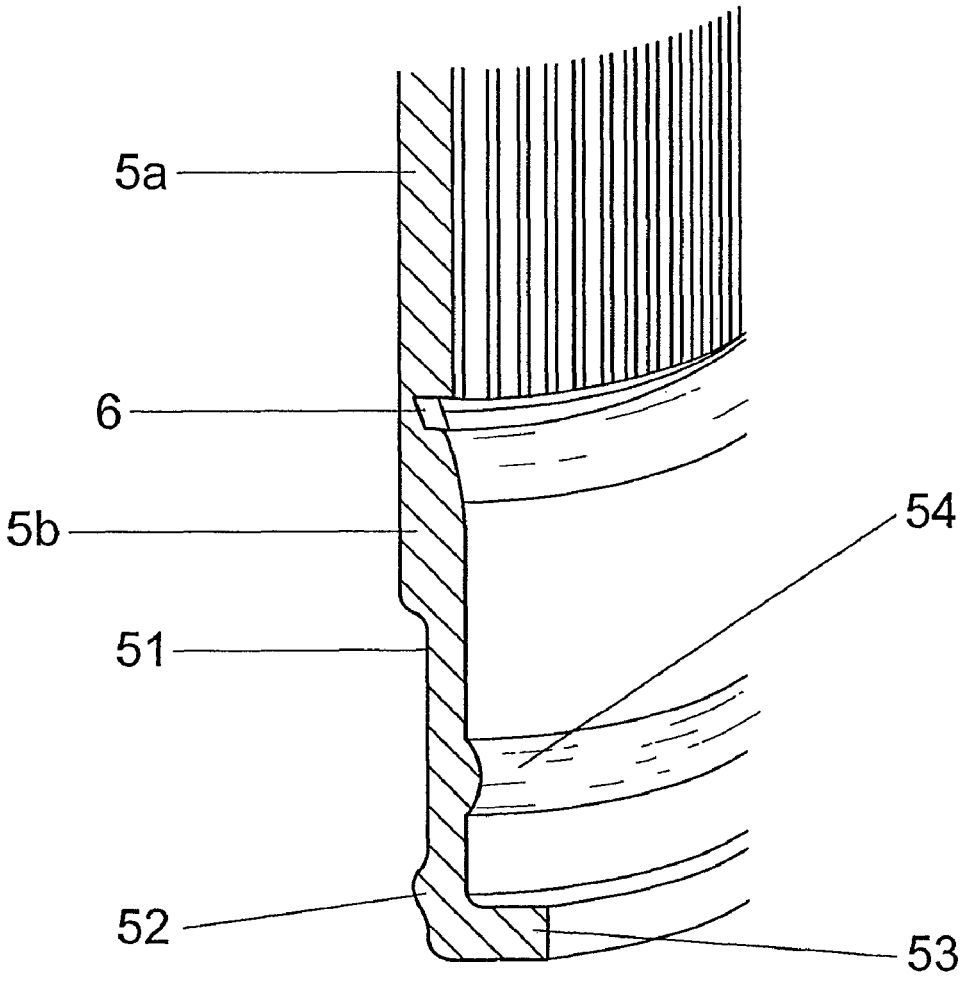
FIG. 5 is a fragmentary enlarged view of the sealing cap.
Figure 6:
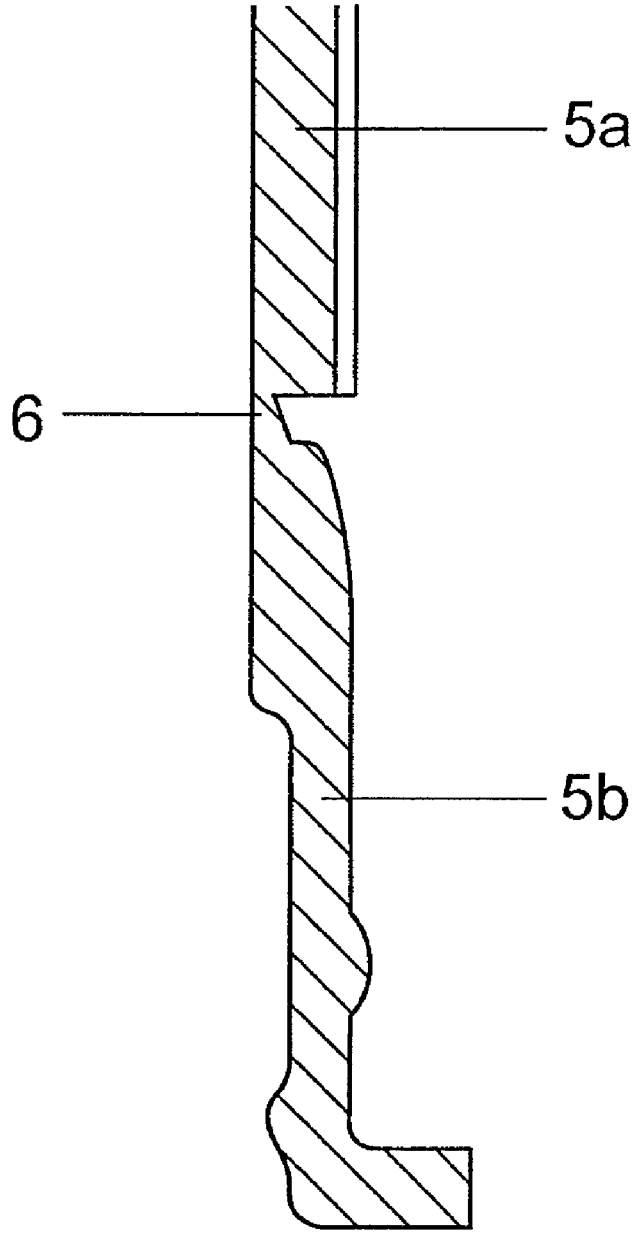
FIG. 6 is a fragmentary enlarged view of the sealing cap.

FIG. 1 is a partially sectioned side view of the container with a pump in this example; FIG. 2*a* is a side view showing the state in which the lid body is detached; FIG. 2*b* is a side view showing the state in which the upper half portion of the sealing cap is detached; FIG. 2*c* shows the state in which the lid body is mounted after the sealing cap is removed (showing the state of use); FIG. 3 is a disassembled view of the container body, the lid body and the sealing cap; FIG. 4 is an enlarged detailed view of the area within circle A in FIG. 1; FIG. 5 is a fragmentary enlarged view of the sealing cap; and FIG. 6 is an enlarged sectional view of the sealing cap.

As shown in FIG. 1, the container with a pump consists of a container body 1, a pump 2, a nozzle part 3, and a lid body 4.

The container body 1 has a mouth-neck portion 11 and a rising wall part (an upward extending wall) 12 formed in a cylindrical shape is furnished on the upper side of the mouth-neck portion 11. A content such as cosmetic liquid is contained inside the container body 1.

The pump 2 is inserted and fitted into the mouth-neck portion 11 of the container body 1, and the nozzle part 3 is mounted onto the upper part of said pump 2 via a pump shaft 3*b* to be operably pressed down. The content is pushed out from the nozzle when the nozzle part 3 is pressed down. The nozzle part 3 has a downward extending wall 3*a* slidably in intimate contact with the rising wall 12 (FIG. 3).

As shown in FIG. 2*c*, the lid body 4 is attached detachably to the container body 1, detached in use and fitted onto the container body 1 to cover and protect the nozzle part 3 after use.

The sealing cap 5 is placed inside the lid body 4 and is fitted and fixed in an unrotatable manner onto the peripheral part of the rising wall part 12 formed on the mouth-neck portion 11 of the container body 1, as shown in FIG. 1 and FIG. 4.

The sealing cap 5 consists of the upper half portion 5*a* and the lower half portion 5*b* formed in a cylindrical shape. In FIG. 3, the state in which the upper half portion 5*a* and the lower half portion 5*b* are separated. When sealed, as shown in FIG. 2*a*, the upper half portion 5*a* and the lower half portion 5*b* are integrally connected with a thin brittle bridge 6.

The upper half portion 5*a* is formed like a cap covering its top with a top plate 5*c* and covers and seals so that the nozzle part is inoperable.

As shown in FIG. 4, in the lower half portion 5*b*, an engaging concave part 51 having a protruding part 52 on the inner periphery is formed and an elevated protruding part 13 for holding formed on the lower outer periphery of the rising wall part 12 of the container body 1 is inserted by pressing; the sealing cap 5 is unrotatably furnished onto the rising wall 12.

A brim part 53 touching the bottom edge of the lid body 4 is formed in the bottom end of the lower half portion 5*b* and an elevated protrusion 54 is formed above the brim part 53. Said elevated protrusion 54 functionally prevents the lid body 4 from coming off when it is put on.

As shown in FIG. 4 and FIG. 5, the upper half portion 5*a* and the lower half portion 5*b* of the sealing cap 5 are integrally connected by the thin brittle bridge 6 for sealing. The thin brittle bridge 6 is a sealing to demonstrate that the product is unused. By twisting or pulling the sealing cap 5, the bridge is torn and the sealing is broken. When the thin brittle bridge 6 is torn and the sealing cap 5 is removed, the nozzle part 3 becomes possible to be operably pushed as shown in FIG. 2*b* and FIG. 3.

The thin brittle bridge 6 is formed between the upper half portion 5*a* and the lower half portion 5*b* of the sealing cap 5, as shown in FIG. 4 and FIG. 5. By twisting or pulling the upper half portion 5*a* of the sealing cap 5, the thin brittle bridge 6 is broken and then the upper half portion 5*a* is separated from the lower half portion, as shown in FIG. 2*b*.

EXAMPLE 2

Figure 7:
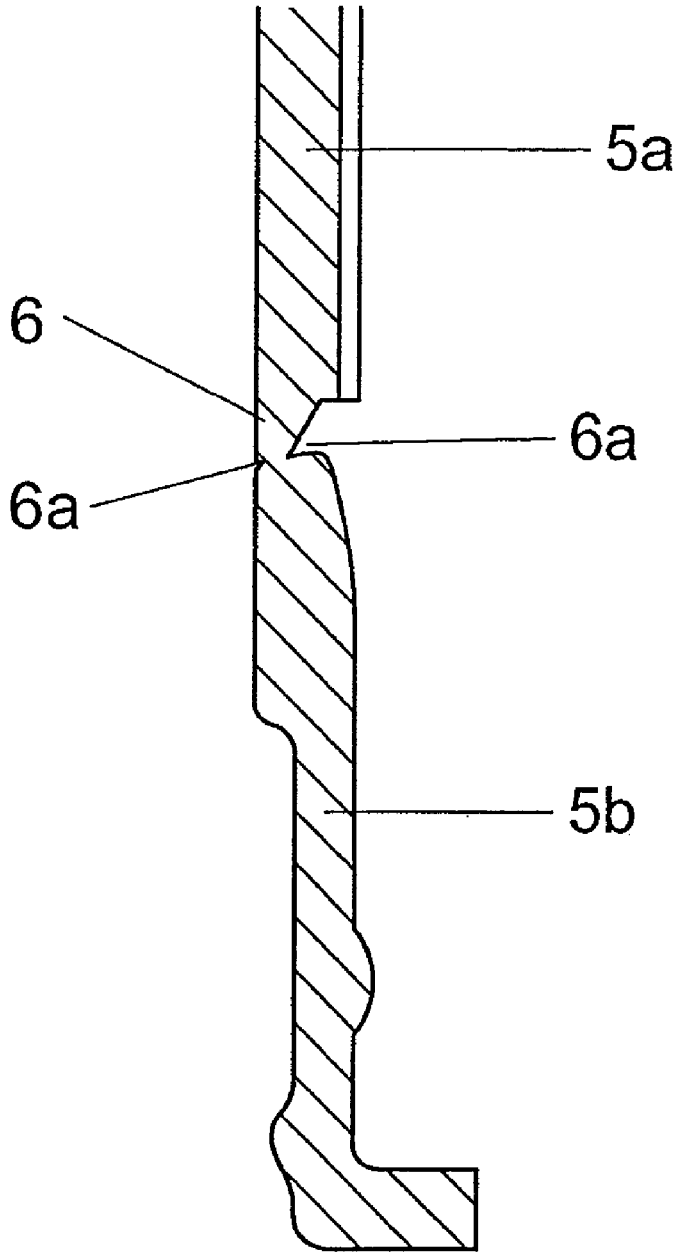
FIG. 7 is a sectional view of the sealing cap in Example 2.

FIG. 7 shows Example 2. In this example, a notch 6*a* is cut in the position to be cut off in the thin brittle bridge 6. By cutting the notch 6*a*, the starting position and the line for the cutting off can be determined in advance and at the same time, the cutting off can generally be carried out smoothly. By cutting the notch 6*a*, the unsettle cutting-off position and the exposure of a cut off piece can be prevented.

By cutting the notch 6*a* within the area of the lower half portion 5*b*, the cut off piece of the thin brittle bridge 6 can be prevented from being exposed to the surface so that appearance will not be spoiled.

Further, by setting the area of the cross section of the thin brittle bridge 6 larger near the upper half section 5*a* than near the lower half portion 5*b*, the cutting off at the notch position can be securely performed.

EXAMPLE 3

Figure 8:
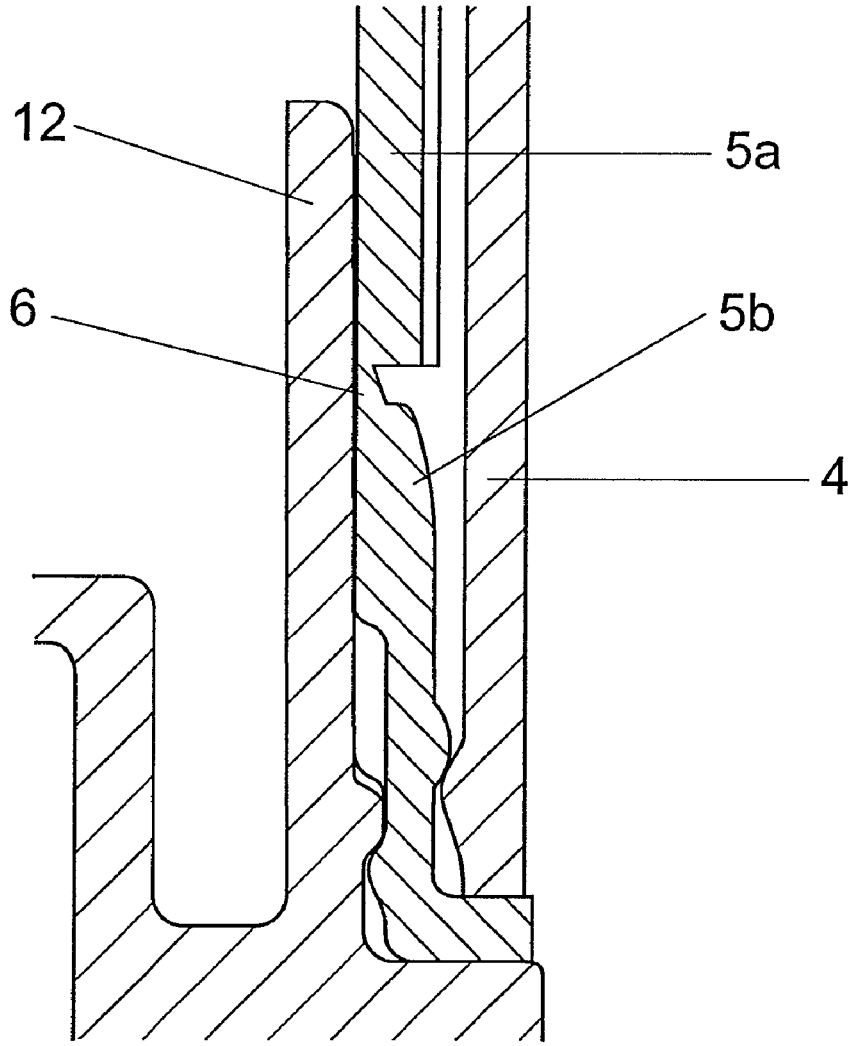
FIG. 8 is a sectional view of the sealing cap in Example 3.

FIG. 8 shows the sealing cap 5 of Example 3. In this example, the thin brittle bridge 6 is furnished to be located below the upper edge of the rising wall 12. For this reason, the upper half portion 5*a* is set up to have a long part overlapped with the rising wall 12. When the upper half portion 5*a* is broken by twisting, the twisting of the upper half portion 5*a* is carried out by making the overlapping part as the axis of rotation, which enables smooth twist turning. Further, also when the thin brittle bridge 6 is broken by pulling, the overlapping part functions as a guiding part for guiding the pulling direction, which enables smooth tearing by pulling.

EXAMPLE 4

Figure 9:
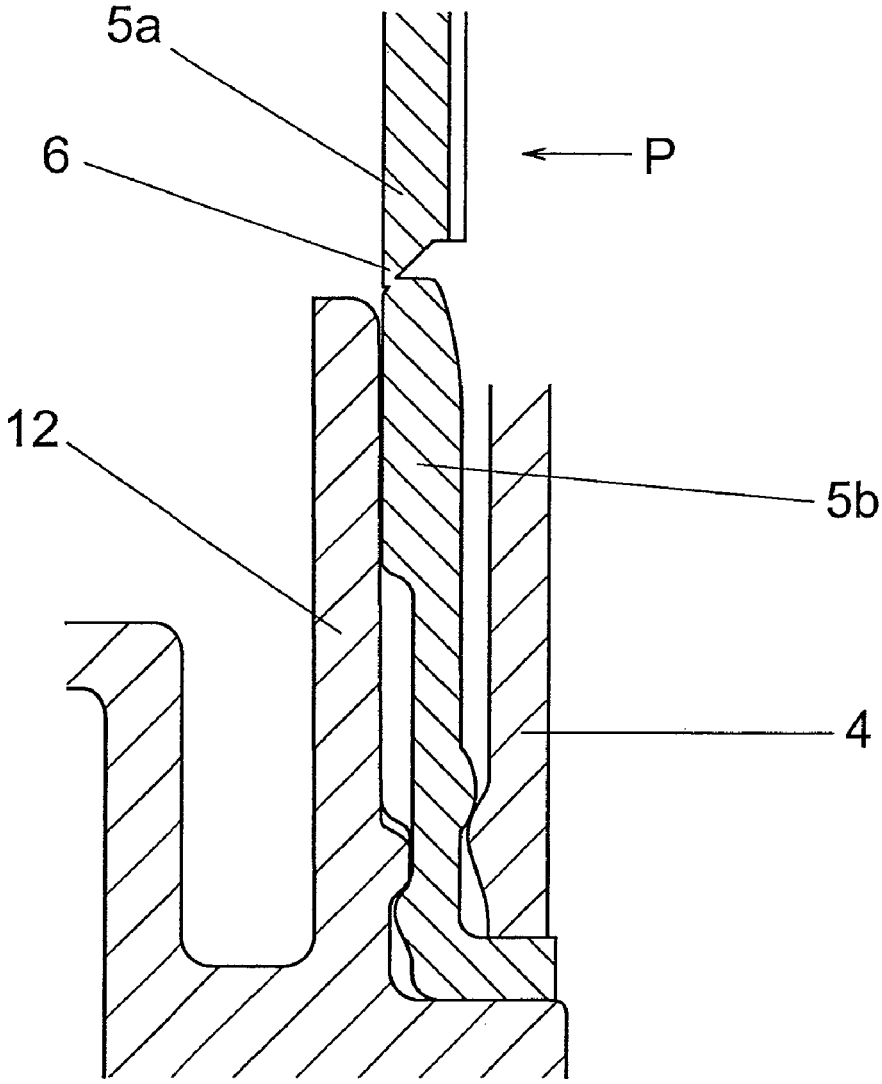
FIG. 9 is a sectional view of the sealing cap in Example 4.

FIG. 9 shows a broken part of the thin brittle bridge 6 in Example 4. In this example, the thin brittle bridge 6 is positioned above the upper edge of the rising wall 12 and formed in a position in which the upper half portion 5*a* can be operably pressed from the outside towards the center of the cylinder. Thus, the thin brittle bridge 6 can be broken by pressing the upper half portion 5*a* from outside. Since the pressing force (p) is apt to be stronger than the twisting force, the thin brittle bridge 6 can be broken more easily and reliably.

The invention claimed is:

1. A container having a container body equipped with a dispensing device and a lid body, characterized in that a sealing cap is provided between the lid body and the dispensing device, wherein the dispensing device is a pumping device comprising a pump, a pump shaft, and a nozzle provided with a downward extending wall downwardly extending from the nozzle and surrounding the pump shaft, the sealing cap comprises a lower-half portion which is fixed onto the container body, an upper-half portion which covers the nozzle of the pumping device, and a brittle part which connects said lower-half and upper-half portions, said lower-half portion and said upper-half portion having the same diameter, the lower-half portion of the sealing cap is fixed on and encloses an outer periphery of an upward extending wall provided in a mouth-neck portion of the container body and reinforces the upward extending wall, wherein an outer periphery of the downward extending wall and an inner periphery of the upward extending wall are slidably in intimate contact with each other to inhibit foreign substances from being pulled in when the nozzle moves up and down relative to the container body, the lid body has a lower portion with an inner circular periphery which is fastenable to and detachably encircles an outer periphery of the lower-half portion of the sealing cap.

2. The container according to claim 1, characterized in that the container is a container for cosmetics.

3. The container according to claim 1, characterized in that the brittle part is a thin part or a bridge.

4. The container described in claim 1, characterized in the brittle part of the sealing cap is furnished to be placed downward from the same height as that of the upper end of said upward extending wall.

5. The container according to claim 1, characterized in that a holding part of the lid body is formed on the outer periphery of the lower-half portion of the sealing cap.

6. A container comprising:

a container body for storing a fluid inside, said container body being provided with a dispensing device supporting portion comprising an upward-extending annular wall;

a dispensing device for dispensing the fluid stored in the container body, said dispensing device being a pumping device and coupled to the dispensing device supporting portion and having a nozzle portion for dispensing the fluid therethrough, said nozzle portion comprising a pump shaft, a nozzle head, and a downward-extending annular wall downwardly extending from the nozzle head and surrounding the pump shaft, wherein an outer periphery of the downward-extending annular wall and an inner periphery of the upward-extending annular wall are slidably in intimate contact with each other to inhibit foreign substances from being pulled in when the nozzle head moves up and down relative to the container body;

a sealing cap for sealing the nozzle portion until the dispensing device is in use, said sealing cap comprising a lower annular portion and an upper portion which covers the nozzle portion and is detachable from the lower annular portion before the use of the dispensing device, said lower annular portion of the sealing cap being fitted onto an outer periphery of the upward-extending annular wall of the dispensing device supporting portion and reinforcing the upward-extending annular wall, said lower annular portion and said upper portion having the same diameter; and a cup-shaped removable lid body for covering the sealing cap and the nozzle portion of the dispensing device therein, said lid body being removably fitted onto the lower annular portion of the sealing cap fitted on the outer periphery of the upward-extending annular wall of the dispensing device supporting portion, wherein the sealing cap is invisible from the outside before the use of the dispensing device, said lid body having a lower portion with an inner annular periphery which is fastenable to and detachably encircles an outer periphery of the lower annular portion of the sealing cap.

7. The container according to claim 6, wherein the sealing cap further comprises:

a brittle part which connects the lower annular portion and the upper portion and is breakable, wherein the upper portion is detachable from the lower annular portion at the brittle part when being broken for the use of the dispensing device, wherein the brittle part is not visible when the lid body is closed in place.

8. The container according to claim 7, wherein the brittle part is formed by a thin part or perforated.

9. The container according to claim 7, wherein the lower annular portion of the sealing cap has a height lower than that of the outer periphery of the upward-extending annular wall of the dispensing device supporting portion.

10. The container according to claim 7, wherein the lower annular portion of the sealing cap has an engaging part for locking on the lid body.

11. The container according to claim 10, wherein the engaging part is constituted by an annular convex portion.

12. The container according to claim 7, wherein the upper portion of the sealing cap is disposable after being separated from the lower annular portion of the sealing cap.

13. The container according to claim 6, wherein the container contains cosmetics.

* * * * *